US005649788A

United States Patent [19]

Jewett

[11] Patent Number: 5,649,788

[45] Date of Patent: Jul. 22, 1997

[54] BI-DIRECTIONAL ANCHOR DRIVE SYSTEM AND METHOD OF USING SAME

[75] Inventor: Thomas E. Jewett, Morrison, Colo.

[73] Assignee: Foresight Products, Inc., Commerce City, Colo.

[21] Appl. No.: 302,992

[22] Filed: Sep. 14, 1994

[51] Int. Cl.[6] ..... E02D 5/74

[52] U.S. Cl. ..... 405/244; 52/163; 405/232; 175/19

[58] Field of Search ..... 52/163, 164, 156; 405/244; 175/414, 19, 20

[56] References Cited

U.S. PATENT DOCUMENTS

| | | | |
|---|---|---|---|
| 334,919 | 1/1886 | Wickizer | 175/19 |
| 835,223 | 11/1906 | Langston | 52/163 |
| 1,002,350 | 9/1911 | Wilcox | 52/163 |
| 1,391,001 | 9/1921 | Moore | 52/163 |
| 1,709,164 | 4/1929 | Birkenmaier et al. | 52/163 |
| 3,100,382 | 8/1963 | Muller | 175/19 X |
| 3,279,136 | 10/1966 | Smith | 405/244 X |
| 3,289,774 | 12/1966 | Bodine | 175/19 |
| 3,379,263 | 4/1968 | Bodine | 175/19 |
| 3,463,251 | 8/1969 | Goodman | 175/19 |
| 3,676,965 | 7/1972 | Deike . | |
| 3,735,822 | 5/1973 | Deike . | |
| 3,747,690 | 7/1973 | Deike . | |
| 3,792,739 | 2/1974 | Deike . | |
| 3,969,853 | 7/1976 | Deike . | |
| 3,969,854 | 7/1976 | Deike . | |
| 4,044,513 | 8/1977 | Deike . | |
| 4,050,526 | 9/1977 | Deike . | |
| 4,096,673 | 6/1978 | Deike . | |
| 4,124,081 | 11/1978 | Deike . | |
| 4,168,751 | 9/1979 | Deike . | |
| 4,802,317 | 2/1989 | Chandler . | |
| 5,010,710 | 4/1991 | Gray et al. . | |
| 5,029,427 | 7/1991 | Jewett . | |
| 5,031,370 | 7/1991 | Jewett . | |
| 5,137,096 | 8/1992 | Druesdon | 175/414 X |
| 5,330,018 | 7/1994 | Griffith | 166/178 X |

*Primary Examiner*—Dennis L. Taylor
*Attorney, Agent, or Firm*—Hill, Steadman & Simpson

[57] ABSTRACT

A system and method are provided for driving a ground anchor and associated anchor rod into the ground. The ground anchor is held securely relative to a drive gad which is reciprocated bi-directionally with an actuator. One end of the anchor rod is pivotally connected to the ground anchor. Another end of the anchor rod is connected either to the drive gad or to the actuator so that the anchor rod is caused to vibrate positively in phase with the anchor. The vibrating anchor liquefies the ground and can be pushed easily through the ground to a desired anchoring position.

19 Claims, 3 Drawing Sheets

BI-DIRECTIONAL ANCHOR DRIVE SYSTEM AND METHOD OF USING SAME

BACKGROUND OF THE INVENTION

The present invention generally relates to ground anchors. More specifically, the present invention relates to systems for driving ground anchors through the ground with a drive rod or drive gad.

A ground anchor is a device which is driven down into soil for securing an anchor rod or cable thereto. The anchor rod or cable has a portion which extends above the surface of the ground which can then be used for anchoring an object. A ground anchor has a socket which has been traditionally configured to loosely receive a drive gad which aligns the anchor in a driving position, so that a cutting edge of the anchor leads a direction of anchor travel.

In prior art systems, the drive gad transmits impacting blows to the anchor, pounding it through the soil with an incremental downward movement. When the anchor has been pounded to a desired depth, the drive gad is pulled away, out of the socket. The anchor rod (or cable) is pivotally attached to the anchor. The anchor rod is pulled through the ground with the anchor via the pivotal connection as the anchor is pounded into the ground. Therefore, the pivotal connection absorbs the momentum of the anchor rod after each impact.

When a desired depth has been reached, the drive gad is removed from the anchor. An upward force on the anchor rod causes the anchor to re-align into an anchoring orientation in the ground so that the anchor cannot be pulled out. Such a ground anchor is disclosed in U.S. Pat. No. 4,802,317, which is incorporated herein by reference.

Prior art driving systems utilize an impact device, such as a jackhammer, to pound the anchor through the ground with a unidirectional force. For example, such driving systems are disclosed in U.S. Pat. Nos. 4,802,317, 5,029,427, and 5,031,370. In practice, impact driving systems result in undesirable effects.

For instance, an impact driving system generates repeated unidirectional blows through a drive gad, resulting in damage and high wear to the anchor and to the drive gad. Particularly, high wear occurs at the pivotal connection of the anchor rod to the anchor, due to repeated absorbing of anchor rod momentum after impact. An anchor rod can weigh as much as twenty or thirty pounds, thus having significant momentum to be absorbed by a typical pin-type pivotal connection. Also, high wear occurs at the point of impact between the drive gad and the socket of the anchor.

A further problem is that impacting generates a great amount of heat and vibration within the drive gad. Heat makes a drive gad difficult to handle when disconnecting it from the actuator, when removing the drive gad from the ground or when attaching a new section thereto. The drive gad can become so hot that it can burn a worker's hand.

Additionally, high grade materials have traditionally been necessary for drive gads due to the effects of unidirectional impact driving. For instance, the materials used to make a traditional drive gad must be very stiff to prevent bending and deflection of the drive gad. If an anchor path is not straight through the ground during impact driving, the drive gad turns in a bowed path. Impact energy is largely wasted from energy transmission into the ground along a bowed drive gad. This slows the driving process and can result in failure of the drive gad.

Moreover, welded joints between multiple drive gad sections are impractical with impact driving. Such joints are desirable because they are simple, however, welded joints quickly fail under impact force conditions. Thus, more expensive mechanical couplings between drive gad sections have previously been necessary such as those disclosed in U.S. Pat. No. 5,031,370.

Therefore, a need exits for an improved ground anchor driving system which overcomes the shortcomings of a traditional unidirectional impact driving system.

SUMMARY OF THE INVENTION

The present invention provides a driving system which reciprocates an anchor and anchor rod together through the ground, resulting in greatly improved performance over impact driving systems. To this end, an apparatus is provided for driving an anchor into the ground. The apparatus includes a drive gad and means for securing the anchor relative to the drive gad. A bi-directional actuator is operable with the drive gad to reciprocate the anchor.

In an embodiment, the means for securing includes a threaded engagement between a drive tip of the drive gad and a socket of the anchor.

In an embodiment, the means for securing includes a drive tip of the drive gad having a radially expandable member. A recess in the socket of the anchor is configured to receive the radially expandable member.

In an embodiment, the anchor has an anchor rod. A first end of which is pivotally secured to the anchor. The means for securing includes a drive tip which is insertable in a socket of the anchor. Means are provided for connecting a second end of the anchor rod to the drive gad proximal to a connection of the gad to the actuator.

In an embodiment, the means for connecting includes a tube welded to the drive gad. A threaded section on the anchor rod is disposed through the tube. At least one nut is threaded onto the threaded section to secure the anchor rod to the tube.

In an embodiment, the anchor has an anchor rod, a first end of which is pivotally secured to the anchor. The means for securing includes a drive tip which is insertable in a socket of the anchor and a releasable connector to operably connect a second end of the anchor rod to the actuator.

In an embodiment, the actuator is adjustable to cause reciprocation of the anchor at a selected frequency.

In an embodiment, an apparatus is provided for driving an anchor and associated anchor rod through the ground. A first end of the anchor rod is pivotally secured to the anchor. The apparatus includes an elongated drive gad which has a driving tip receivable in a socket of the anchor. An actuator is effective to move the driving rod with a pushing and pulling reciprocating motion along a longitudinal direction of the drive gad. A connector is effective to secure a second end of the anchor rod to move with the actuator.

In an embodiment, the means for actuating the anchor rod comprises a connector which secures a second end of the anchor rod to the actuator.

The present invention also provides a method of driving an anchor through the ground. The method includes actuating the anchor to vibrate with a reciprocating force. Pressure is then applied to move the vibrating anchor through the ground.

In an embodiment, the method includes securing the anchor relative to a drive gad which is operably driven by an actuator.

In an embodiment, the method includes screwing a threaded drive tip of the drive gad into a threaded socket in the anchor.

In an embodiment, the method includes expanding a radially expandable drive tip to engage a cooperatively shaped recess in a socket of the anchor.

In an embodiment, the method includes securing an end of the anchor rod to the drive gad.

In an embodiment, the method includes securing an end of the anchor rod to the actuator.

Therefore, an advantage of the present invention is to provide an anchor driving system and method which has greatly improved performance over the prior art.

Another advantage of the present invention is to provide a system and method which drives an anchor into the ground very quickly.

A further advantage of the present invention is to provide a system and method which uses and wastes less energy that prior art systems and methods.

An additional advantage of the present invention is to provide a system and method of driving a ground anchor which is quiet.

Yet another advantage of the present invention is to provide a system and method of driving a ground anchor which does not require use of expensive high-grade materials.

A still further advantage of the present invention is to provide a system and method of driving a ground anchor which does not generate excessive amounts of heat in the components.

Moreover, an advantage of the present invention is to provide a system and method of driving a ground anchor which allows welded joints to be used in a drive gad.

Additionally, an advantage of the present invention is to provide a system and method of driving a ground anchor which effectively operates when the drive gad is bending, allowing an anchor to be driven on a curved path.

Additional features and advantages of the present invention are described in, and will be apparent from, the detailed description of the presently preferred embodiments and from the drawings.

DETAILED DESCRIPTION OF PRESENTLY PREFERRED EMBODIMENTS

Figure 1:
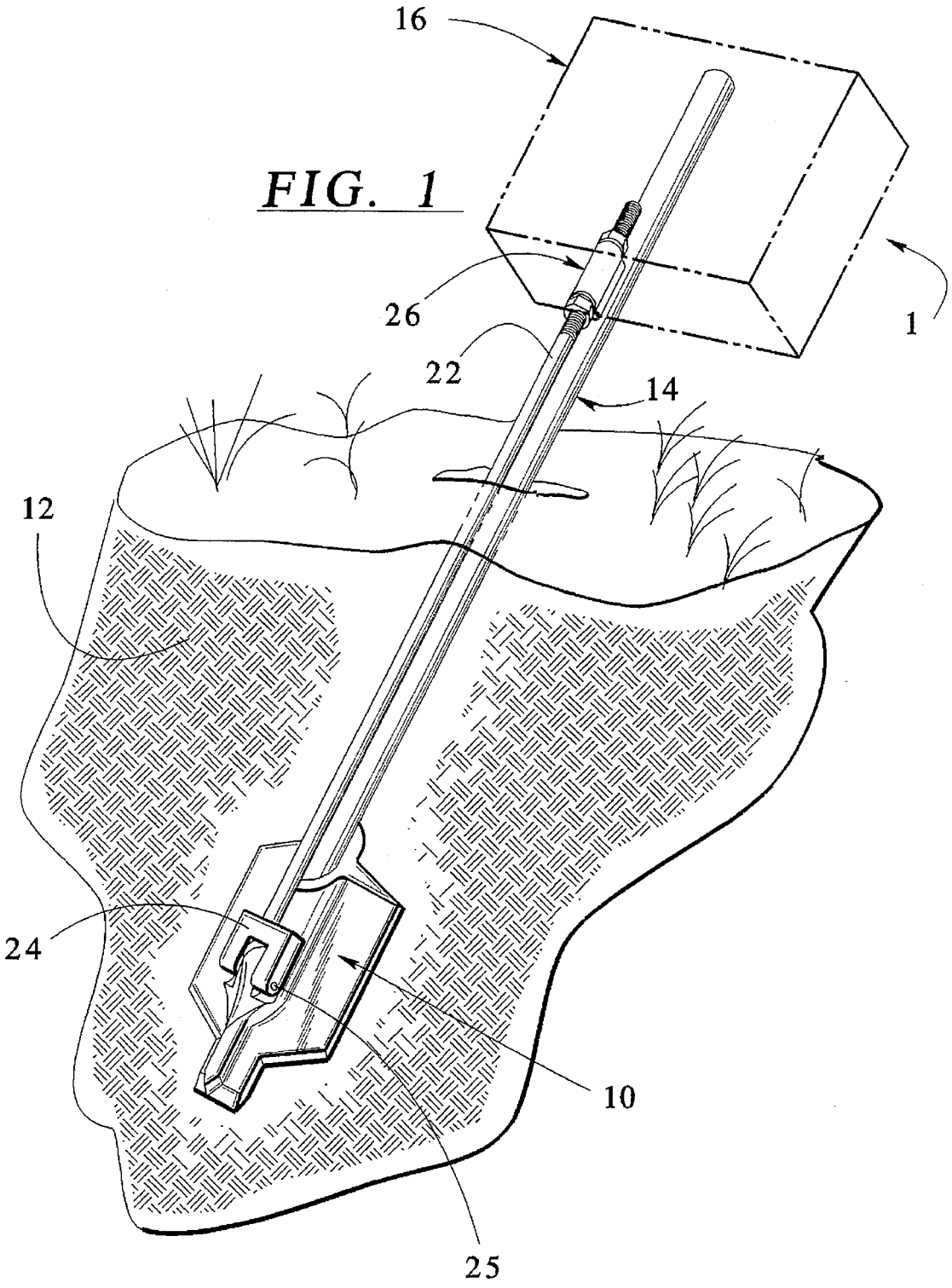
FIG. 1 is a perspective view of an anchor driving system according to the present invention.

In accordance with the invention described with reference to the accompanying figures wherein like numerals designate like parts, the present invention provides a system and method of driving an anchor and associated anchor rod into the ground with a reciprocating, bi-directional force. As illustrated in FIG. 1, a system 1 is provided for driving a ground anchor 10 into the ground 12. Preferably, the ground anchor 10 is of the type disclosed in U.S. Pat. No. 4,802,317. However, the system 1 can be used with other types of ground anchors as well.

The system 1 includes an elongated drive gad 14 which is operably connected to be driven by an actuator 16. A drive tip 18 (see FIG. 2) of the drive gad 14 is receivable in a socket 20 of the anchor 10. An anchor rod 22 is secured to the anchor 10 by a pivotable member 24. The anchor rod 22 is disposed generally parallel to the drive gad 14. The pivotal member 24 is generally U-shaped and connected to the anchor 10 by a pin 25. The anchor rod 22 is threaded into a hole 27 in the pivotal member 24.

The actuator 16 is effective to cause a bi-directional, reciprocating motion of the ground anchor 10, in a generally longitudinal direction along the drive gad 14. In other words, the actuator 16 produces an alternating pushing and pulling force on the anchor 10, causing it to vibrate. Because the anchor rod 22 and the anchor 10 are joined together, both the drive gad 14 and the anchor rod 22 reciprocate in phase. Therefore, a proximal end of the anchor rod 22 opposite the anchor, is also driven by the actuator 16.

Figure 2:
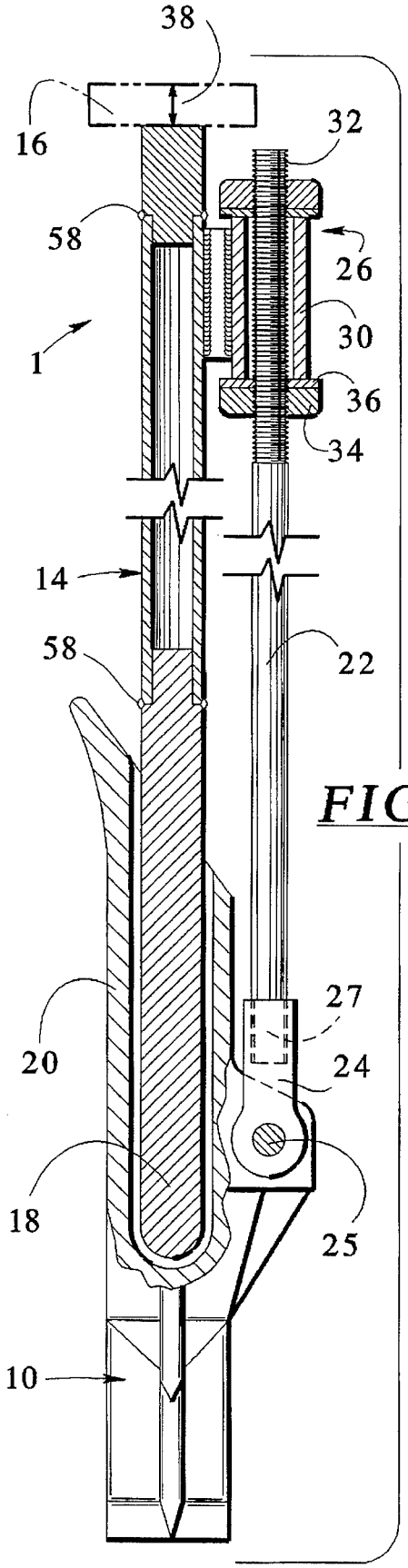
FIG. 2 is an elevated side view of an anchor driving system according to the present invention having portions broken away.

Referring to FIG. 2, the embodiment of FIG. 1 is illustrated in which a generally smooth drive tip 18 is complimentary received within the socket 20 of the ground anchor 10 in a manner to transmit downward driving force to the anchor 10. Also illustrated in FIG. 2 is a connector 26 for securing an end of the gad 14 opposite the anchor relative to the drive gad 14. The connector 26 includes a short tube 30 which is welded to the drive gad 14. A threaded section 32 of the anchor rod 22 extends through the tube 30. A nut 34 and a washer 36 are positioned on the threaded section 32 at each end of the tube 30 to secure the anchor rod 22 thereto. When the nuts 34 are tightened, the anchor 10 is held fixed relative to the drive gad 14.

The actuator 16 causes the drive gad to reciprocate in a generally longitudinal motion as indicated by the arrows 38. The connector 26 transmits the same motion along the anchor rod 22. In the embodiment of FIG. 2, a pushing force is transmitted to the anchor 10 through both the drive gad 14 and the anchor rod 22. A pull-back force is carried by the anchor rod 22, as transmitted through the pivotal member 24. If it is desired to drive downwardly primarily through the gad 14, the lower nut on section 32 may be spaced from the bottom of tube 30.

Figure 3:
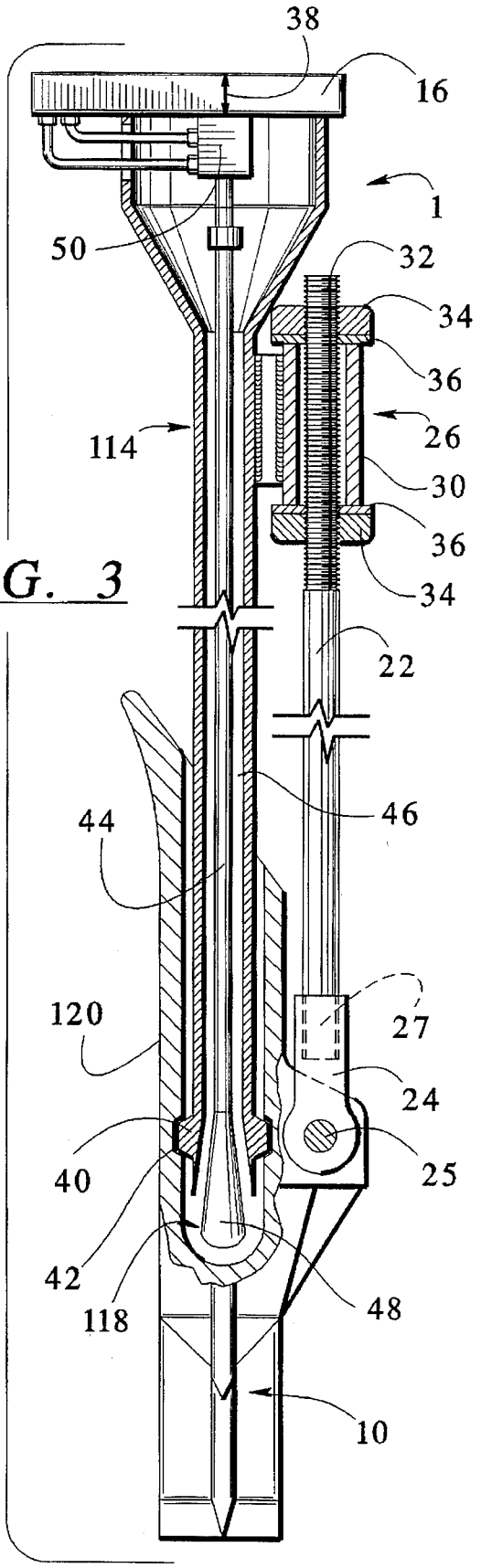
FIG. 3 is an elevated side view of another embodiment of the anchor driving system of the present invention having portions broken away.

Turning to FIG. 3, another embodiment is shown. A drive tip 118 of a drive gad 114 is securable within a socket 120 to transmit both a pushing and pull-back force to the ground anchor. Radially expandable members 40 of the drive tip 118 are configured to be complementarily received within a recess 42 of the socket 120. The radially expandable members 40 are biased normally inward, so that the expandable members 40 do not engage the recesses 42. In this embodiment, a locking rod 44 is coaxially disposed within an interior 46 of the drive gad 114. A tapered collet 48 is provided at an end of the locking rod 44. The locking rod 44 can be pulled upward within the drive gad 114, so that the tapered collet 48 forces the expandable members radially outward to engage the recesses 42. A hydraulic locking cylinder 50 can be provided on the actuator 16 to move the locking rod 44. When the expandable members 40 are engaged in the recesses 42 of the socket, the anchor 10 is secured to the drive gad 114. Therefore, both the drive gad 14 and the anchor rod 22 can transmit the bi-directional reciprocating force caused by the actuator 16. In this embodiment and in the embodiment of FIG. 4, both nuts on the tube 30 may be spaced from the sleeve so that no drive force is transmitted through the rod 22. This embodiment may also be used where the rod 22 is replaced by a cable.

Figure 4:
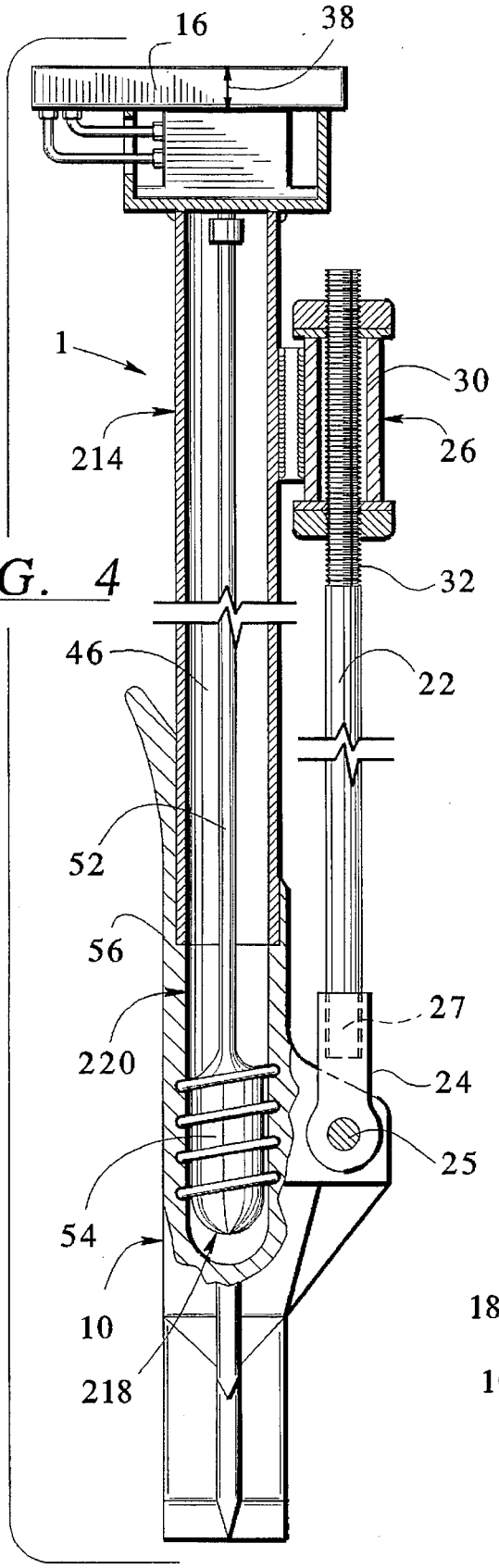
FIG. 4 is an elevated side view of a further embodiment of an anchor driving system according to the present invention having portions broken away.

FIG. 4 illustrates another embodiment of the anchor driving system. A drive tip 218 of a drive gad 214 is securable within a socket 220 of the anchor 10. In this embodiment, a rotatable locking rod 52 is coaxially disposed within the interior 46 of the drive gad 214. A threaded locking member 54 is complimentarily received into a threaded socket 220. The threads are preferably a rope-type or Diwydag-type thread as is known in the ground anchor industry. The threaded locking member 54 tightens to pull an annular, stepped portion 56 in the wall of the socket 20 to squarely engage the drive gad 214, securing the anchor 10 relative to the drive gad 214. Also in this embodiment, the anchor rod 22 is secured between the connector 26 and the pivotal connection on the anchor 10. Therefore, both the drive gad 214 and the anchor rod 22 vibrate in phase and transmits both pushing and pull-back forces to the anchor 10, causing it to reciprocate as indicated by the arrows 38.

Figure 5:
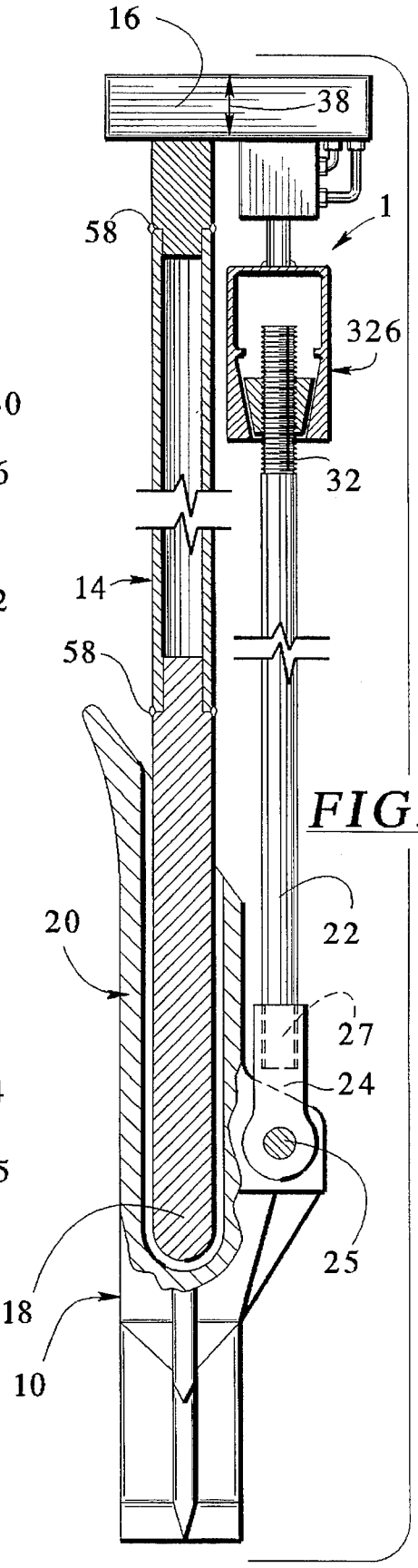
FIG. 5 is an elevated side view of yet another embodiment of an anchor driving system according to the present invention having portions broken away.

In the embodiment illustrated in FIG. 5, the anchor rod 22 is secured to the actuator 16 independently of the connection of the drive gad 14 to the actuator 16. This embodiment results also in imparting a reciprocating motion to the anchor rod 22. As shown, the drive tip 14 and socket 20 are similar to that described above in FIG. 1. However, a locking configuration, such as that shown in FIGS. 3 and 4, could also be used.

Preferably, the connector is a quick-release type connector 326 to speed the anchor-driving process. Also, as shown, the connector 326 provides only a pull-back force through the anchor rod 22. Therefore, in this embodiment, the anchor 10 is subjected to a pushing force transmitted by the drive gad 14 and opposite and alternating pulling force transmitted by the anchor rod, causing the anchor 10 to vibrate.

The embodiments illustrated in FIGS. 1–5 result in a stable in-phase vibrational input to the anchor rod 22 simultaneously with actuation of the anchor 10. Therefore, the actuator positively reverses the momentum of the anchor rod 22 via the connector 26, 326 so that the pivotal member 24 is not subjected to high wear. Also, wear is low in the socket 20, 120, 220 because the anchor 10 is held securely to the drive gad 14, 114, 214.

When the system 1 of the present invention is used, the actuator 16 causes a bi-directional reciprocating vibration of the anchor 10. The anchor 10 is directed generally downward into the ground 12 into a desired direction. A pressure is applied to the actuator 16, pushing the vibrating anchor 10 through the ground 12 in the desired direction. The vibrational motion of the anchor 10 results in a liquefaction of the ground 12, resulting in a very fast motion of the anchor through the ground 12. It has been found that a system 1 according to the present invention can drive an anchor through the ground many times faster than with impact driving.

The actuator 16 can be any device effective to create a bi-directional vibratory force through drive gad 14. In the presently preferred embodiment, the actuator has a hydraulic motor which drives counter rotating eccentric weights. The frequency of reciprocating motion can be 1200 cycles per minute. However, the actuator 16 can preferably be adjusted to operate at faster and slower frequencies as well. Thus an operator can select an optimal frequency which can depend on particular ground conditions.

It has been found that a drive system 1 subjects the drive gad 14, 114, 214 to lower stresses compared to an impact-driving type of system. As a result, welded joints 58 can be used to join sections of the drive gad 14, 114, 214 together or to the drive tip 18, 118, 218. Also, operating temperatures of the drive gad 18, 118, 218 and other components of the system 1 remain relatively low.

Furthermore, the bi-directional reciprocation provides a much more efficient transfer of energy to the anchor compared to impact driving. For instance, a drive gad driven by the present system can force an anchor smoothly through the ground even when the drive gad is deflected or bowed. This allows an anchor to be driven on a curved path, if desired, without breaking the drive gad. Therefore, expensive high-grade materials are not necessary to maintain a rigid, straight disposition of the drive gad 14, 114. 214 as required with impact driving systems.

In addition, the efficient energy transfer results in a relatively quiet driving operation, whereas impacting is loud.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An apparatus for driving an anchor into the ground, the apparatus comprising:

a drive gad having a longitudinal axis;

means for removably securing an anchor bi-directionally axially relative to the drive gad; and a bi-directional actuator operable with the drive gad to reciprocate the anchor along the axis.

2. The apparatus according to claim 1 wherein the means for securing comprises:

a threaded engagement between a drive tip of the drive gad and a socket of the anchor.

3. The apparatus according to claim 1 wherein the means for securing comprises:

a drive tip of the drive gad having a radially expandable member; and a recess in the socket of the anchor configured to receive the radially expandable member.

4. The apparatus according to claim 1 wherein the anchor has an anchor rod, a first end of the anchor rod being pivotally secured to the anchor, wherein the means for securing comprises:

a drive tip which is insertable in a socket of the anchor; and means for connecting a second end of the anchor rod to the drive gad proximal to a connection of the gad to the actuator.

5. The apparatus according to claim 4 wherein the means for connecting comprises:

a tube welded to the drive gad;

a threaded section on the anchor rod disposed through the tube; and at least one nut threaded onto the threaded section to secure the anchor rod to the tube.

6. The apparatus according to claim 1 wherein the anchor has an anchor rod, a first end of the anchor rod being pivotally secured to the anchor, wherein the means for securing comprises:

a drive tip which is insertable in a socket of the anchor; and a releasable connector to operably connect a second end of the anchor rod to the actuator.

7. The apparatus according to claim 1 wherein the actuator is adjustable to cause reciprocation of the anchor at a selected frequency.

8. An apparatus for driving an anchor and associated anchor rod through the ground, a first end of the anchor rod being pivotally secured to the anchor, the apparatus comprising:

an elongated drive gad having a driving tip receivable in a socket of said anchor so that the drive gad is operable to push the anchor;

an actuator effective to move the drive gad with a pushing and pulling reciprocating motion along a longitudinal direction of the drive gad; and a connector effective to secure a second end of the anchor rod relative to the drive gad so that the anchor rod is movable with the actuator, and so that the anchor rod is operable to pull the anchor during said reciprocating motion.

9. The apparatus according to claim 8 further comprising:

a threaded portion of the driving tip; and a threaded wall of the socket configured to engagably receive the threaded portion of the driving tip.

10. The apparatus according to claim 8 further comprising:

a radially expandable member of the drive gad; and a recess in the socket configured to receive the radially expandable member.

11. The apparatus according to claim 8 wherein the connector secures the second end of the anchor rod to the drive gad.

12. The apparatus according to claim 8 wherein the connector comprises:

a tube welded to the drive gad;

a threaded section of the anchor rod disposed through the tube; and at least one nut threaded onto the threaded section to secure the anchor rod to the tube.

13. The apparatus according to claim 8 wherein the means for actuating the anchor rod comprises:

a connector which secures a second end of the anchor rod to the actuator.

14. The apparatus according to claim 8 wherein the actuator is adjustable to cause reciprocation of the anchor at a selected frequency.

15. A method of driving an anchor through the ground comprising steps of:

actuating the anchor to vibrate with a reciprocating force;

applying pressure to move the vibrating anchor through the ground; and securing the anchor relative to a drive gad which is operably driven by an actuator.

16. The method according to claim 15 further comprising the step of:

screwing a threaded drive tip of the drive gad into a threaded socket in the anchor.

17. The method according to claim 15 further comprising the step of:

expanding a radially expandable drive tip to engage a cooperatively shaped recess in a socket of the anchor.

18. The method according to claim 15 further comprising a step of:

securing an end of the anchor rod to the drive gad.

19. A method of driving an anchor through the ground comprising steps of:

actuating the anchor to vibrate with a reciprocating force;

applying pressure to move the vibrating anchor through the ground;

providing an anchor rod which is pivotally secured to the anchor; and securing an end of the anchor rod to the actuator.

* * * * *